US005230228A

United States Patent [19]

Nakano et al.

[11] Patent Number: 5,230,228

[45] Date of Patent: Jul. 27, 1993

[54] CONTROLLER FOR OPERATION OF WASHING MACHINE

[75] Inventors: Shigeharu Nakano, Hitachi; Tamotu Shikamori, Ibaraki; Isao Hiyama, Hitachi, all of Japan

[73] Assignee: Hitachi, Ltd., Tokyo, Japan

[21] Appl. No.: 683,694

[22] Filed: Apr. 11, 1991

[30] Foreign Application Priority Data

Apr. 18, 1990 [JP] Japan ..... 2-100331

[51] Int. Cl.[5] ..... D06F 33/02

[52] U.S. Cl. ..... 68/12.04; 68/12.02; 68/12.05

[58] Field of Search ..... 68/12.02, 12.09, 12.27, 68/12.04, 12.05

[56] References Cited

U.S. PATENT DOCUMENTS 4,235,085 11/1980 Torita ..... 68/12.04
4,779,430 10/1988 Thuruta et al. ..... 68/12.04

FOREIGN PATENT DOCUMENTS 0277995 12/1987 Japan ..... 68/12.04
2077296 3/1990 Japan ..... 68/12.02

*Primary Examiner*—Philip R. Coe
*Attorney, Agent, or Firm*—Antonelli, Terry, Stout & Kraus

[57] ABSTRACT

The quality and quantity of clothes to be washed are measured with a detecting unit, the measured values are referenced to cloth quantity and quality Fuzzy functions to control the strength of wash current, wash time, and rinse time so as to be suitable for the quantity and type of clothes to be washed.

6 Claims, 7 Drawing Sheets

CONTROLLER FOR OPERATION OF WASHING MACHINE

BACKGROUND OF THE INVENTION

1. Field of the Invention

The present invention relates to a controller for controlling the operation of a washing machine so as to achieve an optimum washing operation by detecting the quantity and type of clothes.

2. Description of the Prior Art

A conventional washing machine determines the water current and wash time in accordance with the quantity of clothes to be washed. For example, if the quantity of clothes is small, they are washed with a soft water current for less time. On the contrary, if the quantity of clothes is large, they are washed with a strong water current for a long time.

Therefore, if a small quantity of large-sized clothes such as sheets and bath towels is washed, the cleaning power of the washing machine is weak. On the other hand, if a lot of thin clothes such as lingerie is washed, there is a fear of spoiling them in the washing.

SUMMARY OF THE INVENTION

It is an object of the present invention to eliminate the above disadvantage and provide a controller for controlling the operation of a washing machine so as to achieve a water current strength and wash time suitable for the quantity and quality of clothes to be washed.

It is another object of the present invention to provide a controller for controlling the operation of a washing machine so as to achieve a water current strength, wash time, and rinse time, suitable for the quantity and quality of clothes to be washed.

It is another object of the present invention to provide a controller for controlling the operation of a washing machine so as to achieve a water current strength, wash time, rinse time, and water extract time, suitable for the quantity and quality of clothes to be washed.

In order to achieve the above object of this invention, the quality and quantity of clothes to be washed are measured with a detecting means, the measured values are referenced to cloth stored quantity and quality Fuzzy functions to calculate the strength of wash current, and wash time, to thereby achieve an optimum operation of the washing machine.

More in particular, membership functions according to the Fuzzy theory are defined for the cloth quantity and type, the strength of water current, for example. Rules are defined for the washing conditions such as large or small cloth quantity, large-sized or thin cloth type, strong or weak water current, and so on. Each rule is executed using the Fuzzy theory to thereby achieve an optimum operation of the washing machine.

BRIEF DESCRIPTION OF THE DRAWINGS

The accompanying drawings illustrate a particular structure of an embodiment of the controller according to the present invention.

DESCRIPTION OF THE PREFERRED EMBODIMENTS

A particular structure of an embodiment of the controller according to the present invention will be described.

Figure 1:
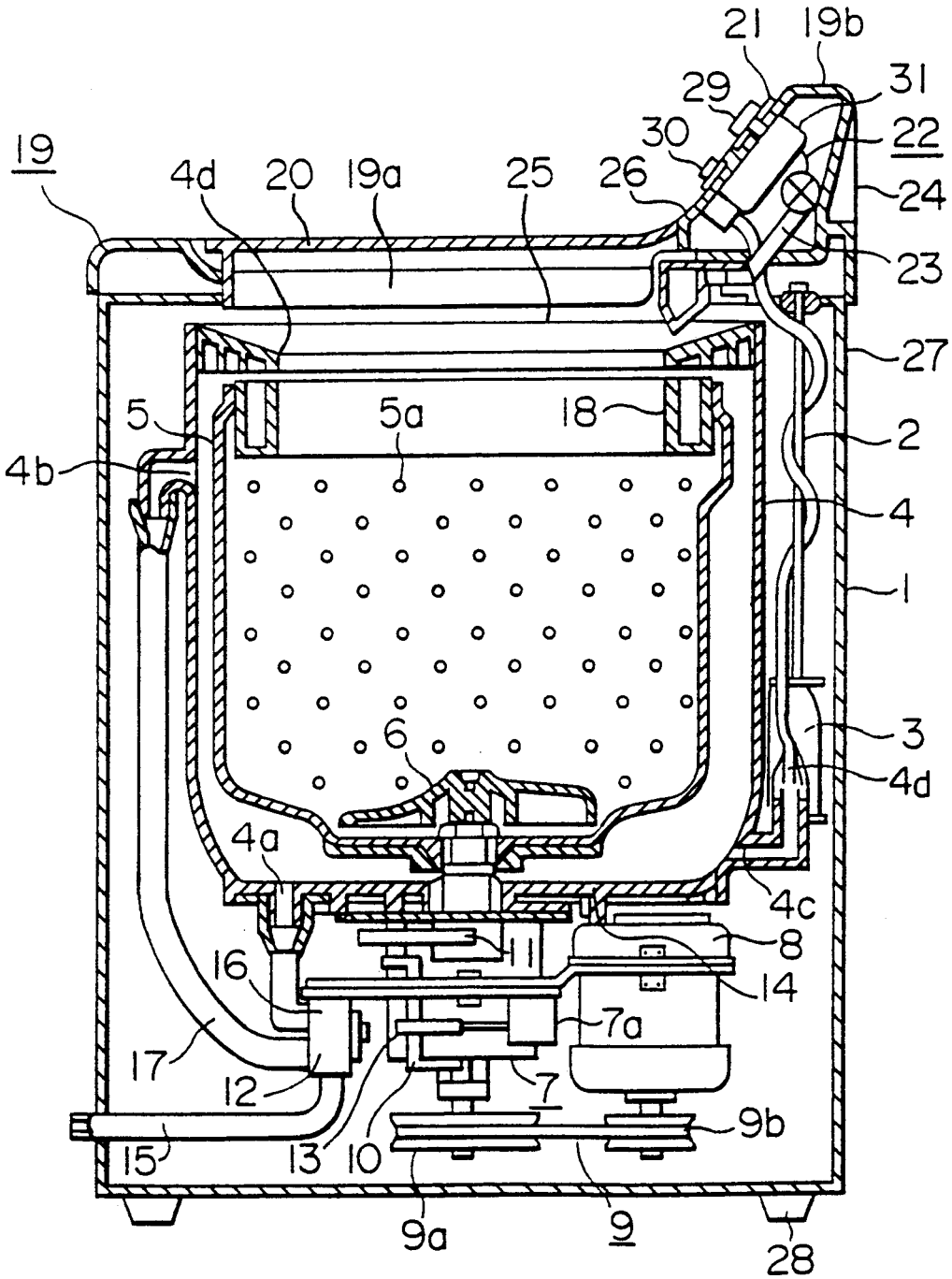
FIG. 1 is a cross sectional view showing a completely automatic washing machine.

Referring to FIG. 1 within an outer frame 1 made of steel plate, an outer tub 4 made of synthetic resin is suspended by means of vibration proofing units 3 each being constructed of a suspending rod 2, coil spring, elastic rubber, for example. There are provided four vibration proofing units 3.

A washing/water-extract tub 5 made of synthetic resin is rotatably mounted within the outer tub 4, water being supplied within the washing/water-extract tub 5 and outer tub 4. A number of water extract holes 5*a* are formed in the washing/water-extract tub 5. At the center of the bottom of the washing/water-extract tub 5, there is rotatably mounted a rotary member 6 like a pulsator or an agitator. During a washing process and rinsing process, the washing/water-extract tub 5 is stopped and the rotary member 6 is rotated in the clockwise and counter clockwise directions. During a water extract process, the washing/water-extract tub 5 is rotated in one direction. The rotary member 6 and washing/water-extract tub 5 are rotated by means of a driver unit 7.

The driver unit 7 is constructed of a motor 8, a transmission means 9, a clutch unit 10, a solenoid 7*a*, and a water drainage unit 12. The transmission means 9 is constructed of a pulley 9*a* and a belt 9*b*, and transmits the rotation of the motor 8 to the rotary member 6 or washing/water-extract tub 5. The clutch unit 10 is switched by the solenoid 7*a* in order that only the rotary member 6 is rotated during the washing and rinsing processes or the washing/water-extract tub 5 is rotated during the water extract process. The water drainage unit 12 operates to drain water.

The driver unit 7 is fixedly mounted on a support plate 14 of steel plate near at the bottom surface of the outer tub 4. The outer tub 4 is formed with a guide port 4*c* to which an air tube 4*d* is coupled to transmit the water pressure within the outer tub 4 to a water level sensor 26.

A top cover 19 made of synthetic resin is mounted at the top of the outer frame 1. The top cover 19 is formed with an opening 19*a* for entering washing clothes into the washing/water-extract tub 5, and an operation box 19*b* for housing therein electrical components such as a controller unit. There is provided a lid 20 made of synthetic resin for covering the opening 19*a*.

An operation panel 21 is mounted on the upper surface of the operation box 19*b*. A water supply electromagnetic valve 24 is mounted within the operation box 19*b*.

The water level sensor 26 disposed within the operation box 19*b* detects the water pressure within the outer tub 4 to thereby judge if water has been supplied to a predetermined water level. The water level sensor 26 is constructed of a core, a coil, a spring, for example.

Within a housing box 31, there is disposed the controller unit for controlling the washing, rinsing, water extracting, and other processes.

The operation panel 21 is equipped with a power switch button 29 and external operation switches 30.

Figure 2:
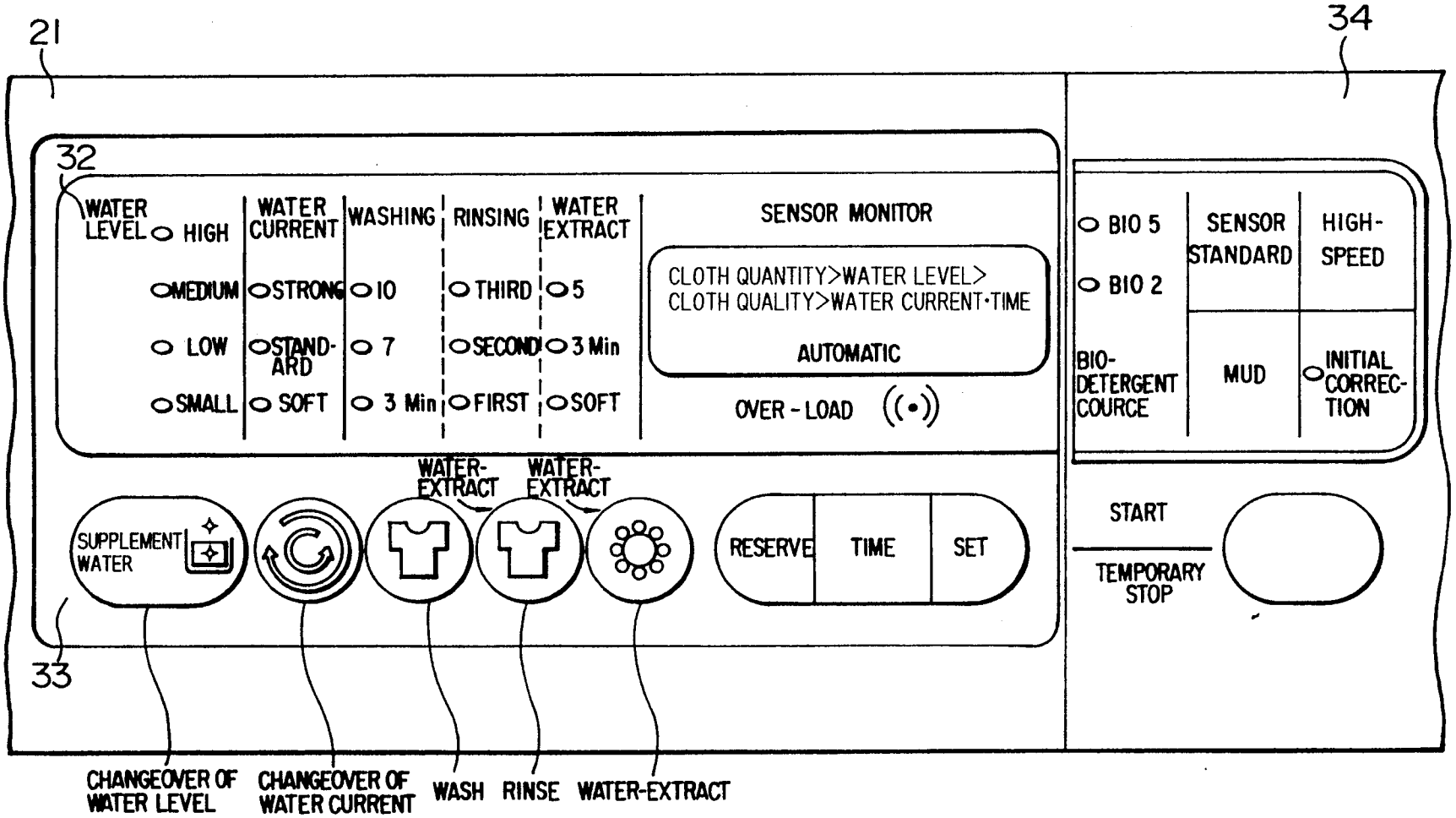
FIG. 2 shows the operation panel of the washing machine.

FIG. 2 shows the operation panel 21.

With the washing machine constructed as above, when the power switch button 29 is depressed to turn on the power switch and a "sensor standard" button for one of the external operation switches is depressed, the water supply electromagnetic valve 24 is powered in response to a signal from the controller unit so that water is supplied to the washing/water-extract tub 5. The solenoid 7*a* is also powered at this time such that the motor is powered on for 0.5 second and off for 4 seconds. As a result, the washing/water-extract tub 5 rotates slowly in one direction to thereby allow water to be distributed uniformly over the washing clothes. In this case, the clutch unit is set similar to the case of the water extract process.

When the water level sensor 26 detects the lowest water level set for initial water supply, the water supply electromagnetic valve 24 and solenoid 7*a* are turned off and the motor 8 is powered to start agitating. In this case, the clutch unit 10 is correctly switched from the water extract process state to the washing process state. The motor 8 is driven for 8 seconds such that the rotary member 6 is reciprocally rotated to produce an alternate agitating water current while turning on for 0.5 second and off for 0.5 second, the strength of this alternating water current being stronger than that during the cloth quantity detection process and weaker than that during ordinary agitating so as not to spoil the washing clothes. This 8 second operation is a running-in operation before the cloth quantity detection process.

Figure 3:
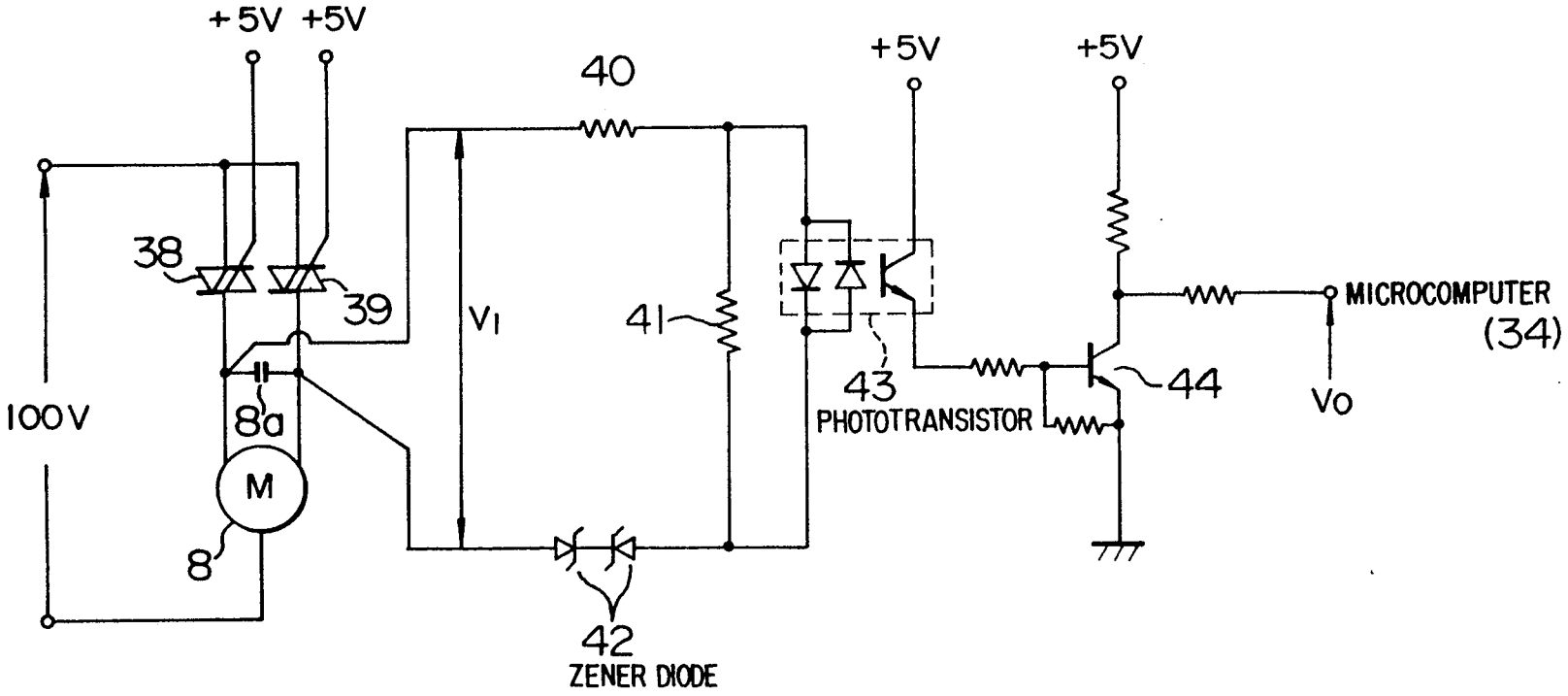
FIG. 3 is a circuit diagram of detecting means for detecting the quantity and quality of clothes.
Figure 4:
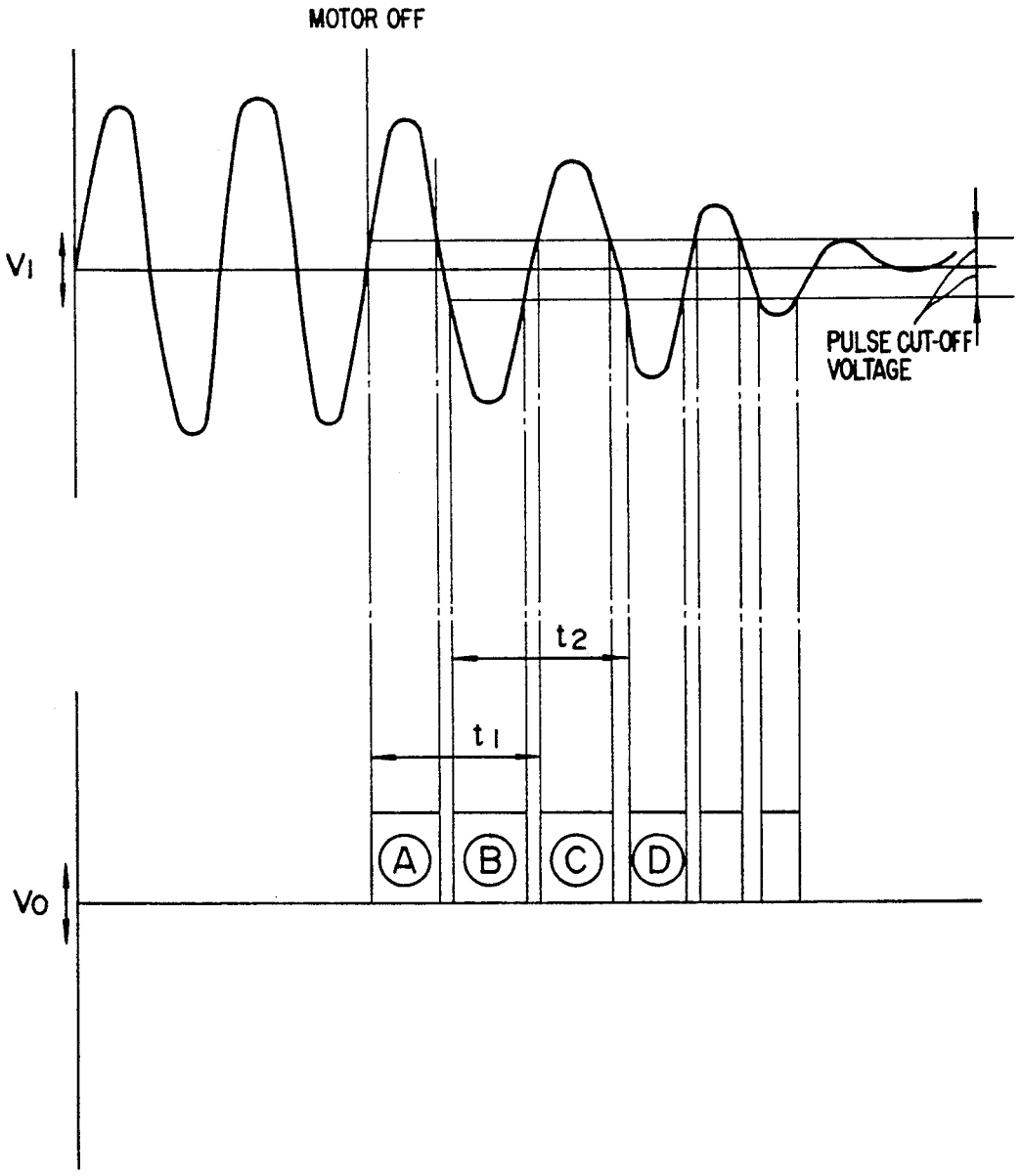
FIG. 4 shows pulses detected by the detecting means shown in FIG. 3.

During the cloth quantity detection process, the rotary member 6 is reciprocally rotated for producing alternate agitating current while turning on for 0.4 second and off for 1 second. The counter electromotive force of the motor 8 rotating by its inertial force during the off-period is detected as a voltage across a driver capacitor 8*a* of the motor 8. This detected voltage is converted into d.c. rectangular pulses. A time duration tl between pulses is measured to determine the cloth quantity. If the quantity of clothes is large, a large resistance is applied to the rotary member 6 and the rotation of the motor by the inertial force is suppressed, thereby resulting in a longer time duration tl. On the other hand, if the quantity of clothes is small, the time duration tl between pulses becomes shorter. There is measured the time duration tl between the rise times of the first and third pulses (A) and (C) detected by the circuit shown in FIG. 3 (refer to FIG. 4). This measurement is repeated 20 times. The total time is used for determining the cloth quantity while referring to the relationship between cloth quantity and total time previously stored in a microcomputer within the control unit. The water level for the determined cloth quantity is automatically set to supply water to a rated water level.

Figure 5:
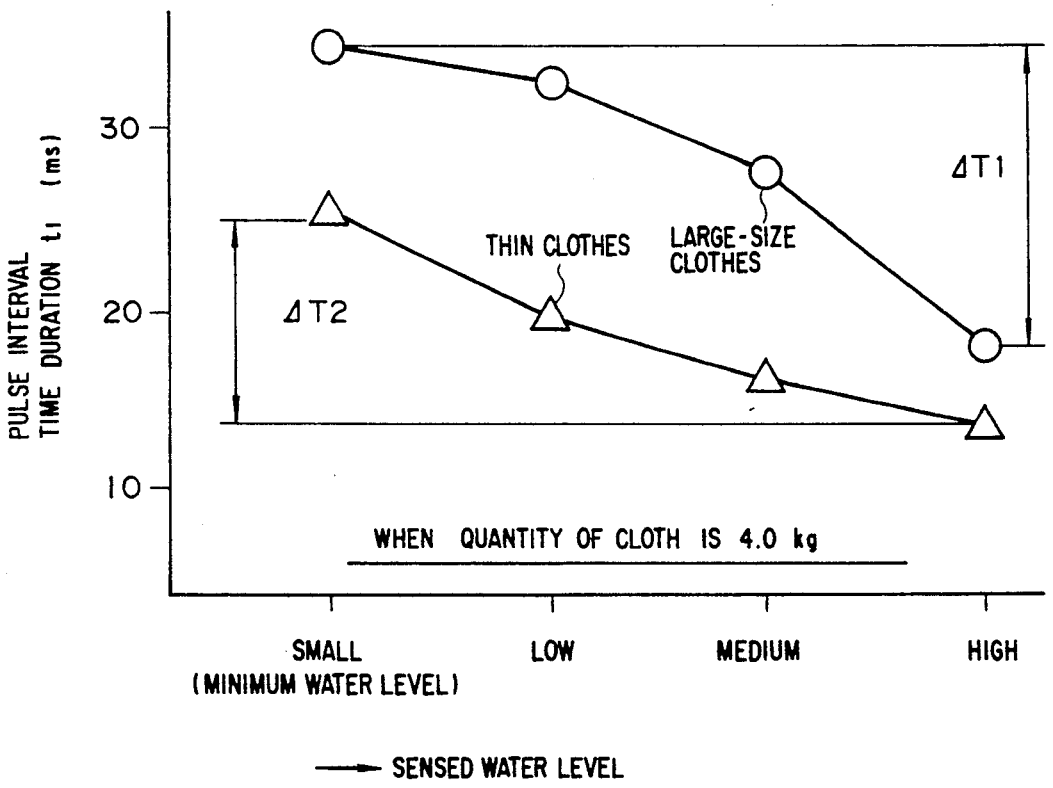
FIG. 5 is a graph showing the interval between pulses detected by the detecting means.

The cloth quantity detection process is repeated to measure the pulse rise time intervals tl at various water levels until water is supplied to the rated water level. For example, the pulse rise time intervals tl at various water levels may be represented by curves shown in FIG. 5 for different washing clothes of 4.0 Kg (for large-size clothes such as sheets, bath towels, and for light-weighted clothes such as thin clothes made of chemical fibers). It is possible to discriminate between the types of clothes (cloth quality) by:

(1) calculating a difference $\Delta T$ between tl at the lowest and rated water levels (large-size clothes $\Delta T1 >$ thin clothes $\Delta T2$), and (2) obtaining an approximate function of each curve of FIG. 5. It is therefore possible to wash clothes at an automatically set suitable water current, wash time, rinse time and the like (large-size clothes are washed at a strong water current for a long time, whereas thin clothes are washed at a weak water current for a short time).

Using the Fuzzy theory, it becomes possible to wash clothes in the manner as many housewives do, by incorporating the data regarding the cloth quantity (large, medium, small) and cloth type (large-size, standard, thin) into Fuzzy functions which are stored in the microcomputer of the controller and setting a water current (on/off time and speed of motor) and wash time.

Figure 6:
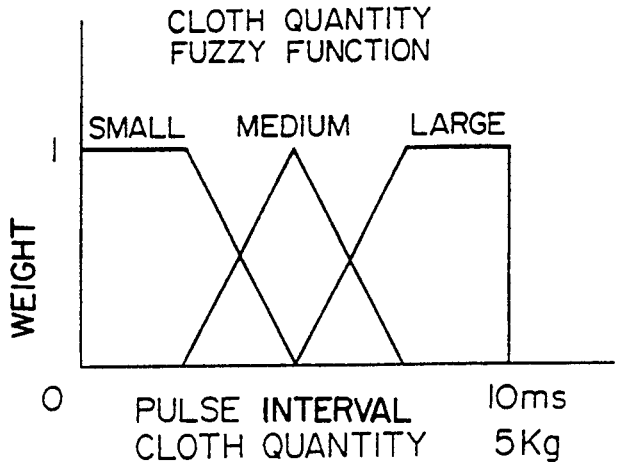
FIG. 6 is a diagram conceptually illustrating the cloth quantity Fuzzy function.
Figure 7:
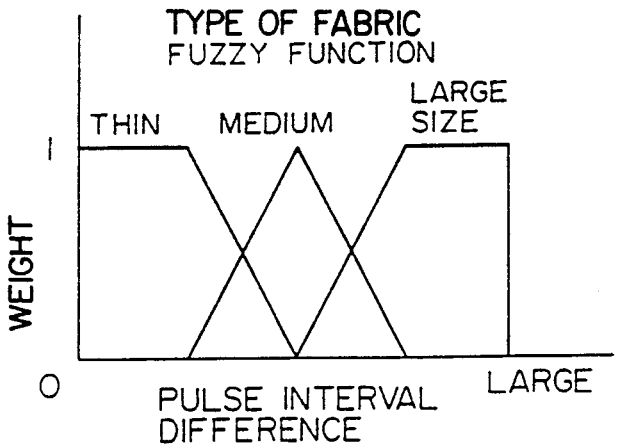
FIG. 7 is a diagram conceptually illustrating the cloth quality Fuzzy function.
Figure 8:
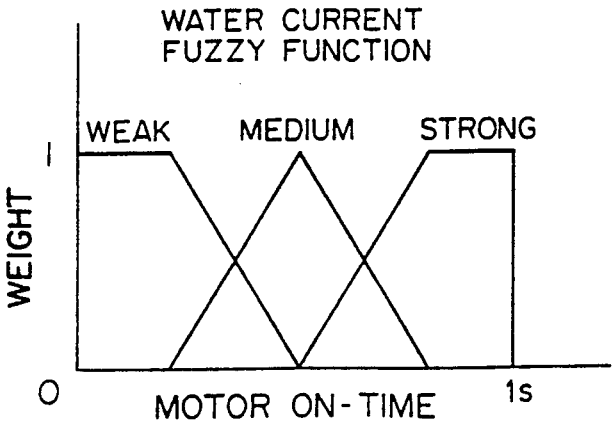
FIG. 8 is a diagram conceptually illustrating the water current Fuzzy function.

For example, the membership function (hereinafter called a Fuzzy function) according to the Fuzzy theory for the cloth quantity can be described as shown in FIG. 6. The Fuzzy function for the cloth type or cloth quality can be described as shown in FIG. 7. The Fuzzy function used for controlling the strength of the water current in accordance with the cloth quantity and type or quality can be given as shown in FIG. 8. The following rules are defined for the Fuzzy functions as in the following.

Rule A: (if the cloth quantity is medium, water current is medium)

Rule B: (if the cloth type is stiff, water current is strong)

Figure 9:
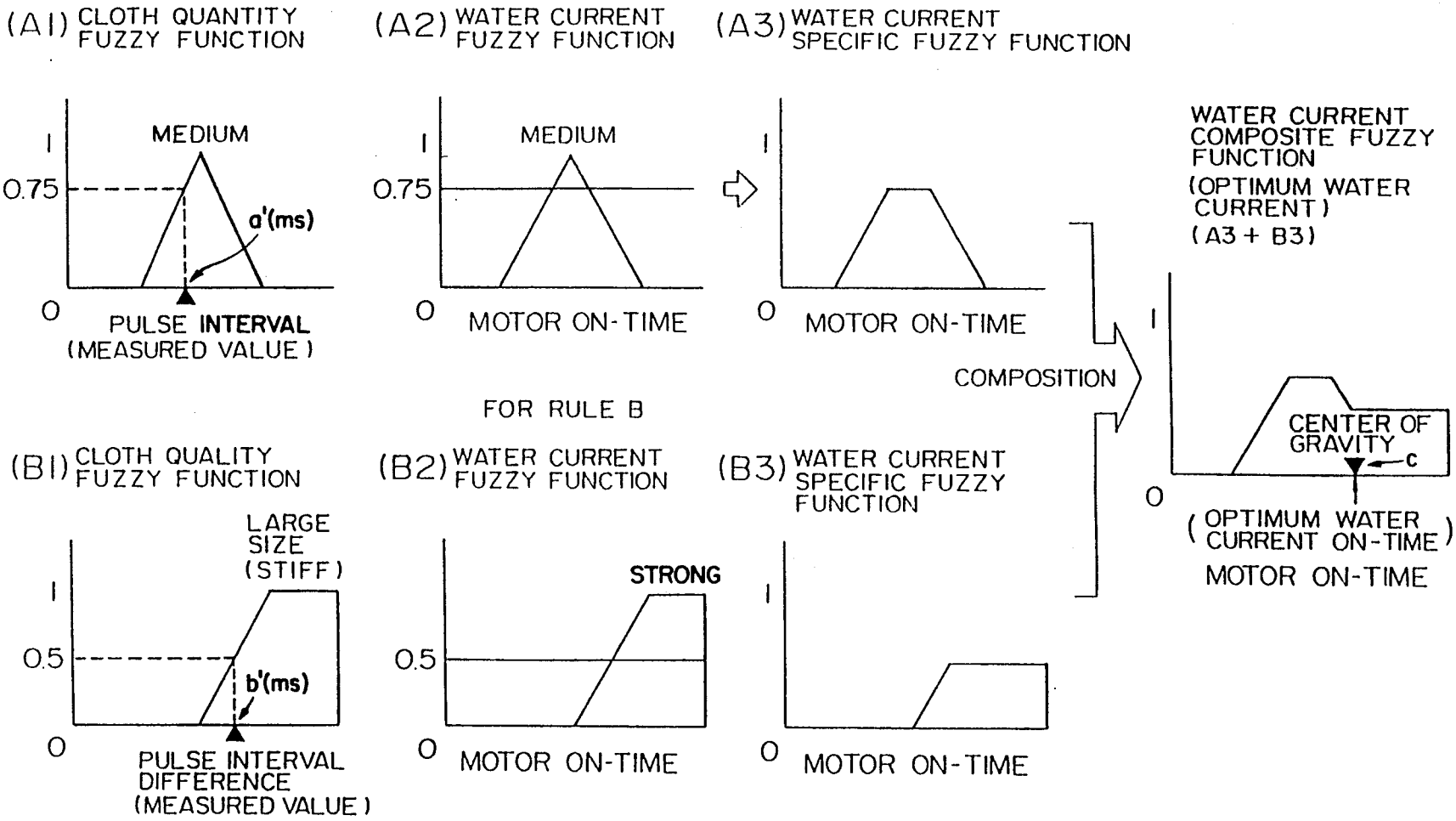
FIG. 9 are diagrams illustrating Fuzzy inference rules.

As shown in FIG. 9, a water current Fuzzy function (A3) is obtained based on Rule A, and a water current Fuzzy function (B3) is obtained based on Rule B. The two functions are composed, and the center of gravity of this composite Fuzzy function is calculated by the microcomputer and becomes an optimum motor on-time which is used during washing machine operation to determine the actual motor on-time.

According to the Fuzzy theory, various methods are possible, one of which has been given by way of example.

In the cloth quantity detection process, if the maximum value of pulse widths at respective water levels is larger than the pulse width detected when water is supplied to the rated water level, it means that too much clothes have been put into the tub 5. In such a case, a user is informed of too much clothes by means of a buzzer and an abnormal state indication (((.)) mark), to thereby prevent spoiling clothes and motor overload. Although a buzzer alarm continues for a short period of 10 to 20 seconds and the abnormal state indication continues until the washing is completed or the clothes are partially removed, the operation of the washing machine is not interrupted but continues until the washing is completed, even upon occurrence of an information of too much clothes, thereby providing an easy handling of the machine by a user.

If various detection functions are provided for detecting the cloth quantity, cloth type, for example, a user becomes restless because the user cannot know externally which operation is now being carried out by the washing machine. In view of this, a sensor monitor as shown in FIG. 2 is provided on the operation panel. The sensor monitor sequentially flashes its display for a particular operation of the washing machine, such as flashing a cloth quantity display during the cloth quantity detection process, flashing a water level display when a water level is determined, and so on. In this manner, each detection process is definitely indicated to give a user a sense of relief.

The Fuzzy functions shown in FIGS. 6 to 8 and the Fuzzy inference rules shown in FIG. 9 will be described in detail.

FIG. 6 shows a cloth quantity Fuzzy function. The ordinate represents a weight or occurrence frequency, and the abscissa represents both the pulse interval and cloth quantity. As the cloth quantity increases from 0 to 5 kg in the example, the interval of a pulse detected by the detecting means is increased, from 0 to 10 ms in the example. The weight corresponds to the results of an empirical method, that is, the contents of decisions made by housewives as to the cloth quantity for cloth quantities ranging from 0 to 5 kg. For example, if all, 100 housewives, decide that a given cloth quantity is small, the weight for the small cloth quantity takes a value "1". If 50 housewives decide that the cloth quantity is small, the weight for small cloth quantity takes a value "0.5". In the similar manner, the weights for medium and large cloth quantities are determined. A Fuzzy function also called a membership function is used for judging the absolute value measured with the detecting means because the judgment varies with each person and is subjected to, a personal preference.

FIG. 7 shows the type of fabric or cloth quality Fuzzy function. The ordinate again represents the weight or occurrence frequency determined by the aforementioned empirical method, and the abscissa represents thee detected pulse interval difference in units of time for the various types of fabric from thin, such as lingerie to large size, e.g. sheets and bath towels corresponding to $\Delta T1$ and $\Delta T2$ shown in FIG. 5. As the cloth quality becomes large-sized, the pulse interval difference becomes large. FIG. 8 shows the water current Fuzzy function. The ordinate again represents the weight or occurrence frequency, based on decisions by housewives and the abscissa represents the on-time of the motor, from 0 to 15 in the example. As the on-time of the motor becomes long, the water current becomes strong. This washing condition is obtained while the agitating vane (rotary member) is reciprocally rotated using a short on-time equal to or shorter than 3 seconds. The strength of water current can be regulated by adjusting the off-time and on-time.

FIG. 9 shows how an optimum water current on-time (strength of water current) taken as the value of the motor on-time at c in the right most Fuzzy function in FIG. 9, is calculated from a composite Fuzzy function obtained from a specific water current Fuzzy function (A3) based upon the cloth quantity determined Rule A and the detected pulse interval and a specific water current Fuzzy function (B3) based upon the cloth quality determined by Rule B and the detected pulse interval difference as discussed below.

First, as to Rule A, the weight or occurrence frequency, 0.75 in the example, for a measured pulse interval a' (ms), is read from the corresponding cloth quantity Fuzzy function (A1) stored in the microcomputer. Since the applicable Fuzzy function is the medium cloth quantity Fuzzy function is selected as shown in A2. The corresponding value of the read weight of occurrence frequency, 0.75 is then applied to the water current curve of A2 that has been selected according to Rule A to obtain the modified water current curve as illustrated in FIG. 9-A3 where the upper parts of the curve above 0.75 are removed On the other hand, as to Rule B, the occurrence frequency for a measured pulse interval difference B' (ms) is read from the corresponding cloth quality Fuzzy function (B1) stored in the microcomputer. The corresponding value, 0.5, to the read occurrence frequency is applied to the water current Fuzzy function (B2) obtained according to the aforesaid Rule B to modify the function as indicated by removal of the portion of the curve above the valve 0.5 to obtain the specific water current Fuzzy function (B3).

The calculated Fuzzy functions (A3) and (B3) are composed together (A3+B3 as indicated in FIG. 9) to obtain a water current composite Fuzzy function and determine an optimum water current on-time (motor on-time). This optimum water current on-time is derived as the center of gravity of the water current composite Fuzzy function, the value for on-time at C in A3+B3.

According to the present invention, the quantity of washing clothes (cloth quantity) and the quality of washing clothes (cloth quality) are detected, and the detected cloth quantity and quality are processed using the Fuzzy theory to automatically determine an optimum water current, wash time, and water extract time. As a result, washing can be carried out in the manner suitable for the quantity and quality of washing clothes, thereby enhancing the cleaning force for large-size clothes and preventing thin clothes from being spoiled.

The motor may use a speed variable inverter motor or the like, to provide finer washing and water extracting processes.

What is claimed is:

1. A controller for controlling an operation of a washing machine, by utilizing a detected quantity of clothes to be washed and a detected quality of clothes to be washed, said controller comprising means for defining a first region corresponding to a clothes quantity by a first Fuzzy function and the detected quantity of clothes and means for defining a second region corresponding to a cloth quality by a second Fuzzy function and the detected quality of clothes, and means for composing said first region and second region together to control a strength of water current, a wash time, a rinse time, and a water extract time.

2. A controller for controlling the operation of a washing machine according to claim 1, wherein said strength of water current is controlled in accordance with an on-time and off-time of a motor of said washing machine.

3. A controller for controlling the operation of a washing machine according to claim 1, wherein said strength of water current is controlled in accordance with the speed of a motor.

4. A controller for controlling the operation of a washing machine, said controller comprising means for detecting a quantity of clothes to be washed and a quality of clothes to be washed, means for calculating an on-time of a rotary vane for washing and rinsing, a wash time and a rinse time by utilizing a quantity Fuzzy function corresponding to said detected quantity of clothes to be washed and a quality Fuzzy function corresponding to said detected quality of clothes to be washed.

5. A controller for controlling an operation of a washing machine, said controller comprising means for detecting a quantity of clothes to be washed and a quality of clothes to be washed, and means for calculating strength of a wash current, a wash time, and a rinse time by utilizing a quality Fuzzy function corresponding to said detected quality of clothes to be washed and a quantity Fuzzy function corresponding to said detected quantity of clothes to be washed.

6. A controller for controlling an operation of a washing machine, said controller comprising means for detecting a quantity of clothes to be washed and a quality of clothes to be washed, and means for calculating a strength of a wash current, a wash time, and a washing water level by utilizing a quality Fuzzy function corresponding to said detected quality of clothes to be washed and a quantity Fuzzy function corresponding to said detected quantity of clothes to be washed.

* * * * *